US006543226B1

(12) United States Patent
Bischoff et al.

(10) Patent No.: US 6,543,226 B1
(45) Date of Patent: Apr. 8, 2003

(54) EXHAUST GAS TURBOCHARGER WITH A VARIABLE TURBINE GEOMETRY

(75) Inventors: Roland Bischoff, Pluederhausen (DE); Helmut Daudel, Schorndorf (DE); Guenter Fleckenstein, Esslingen (DE); Hermann Hiereth, Esslingen (DE)

(73) Assignee: DaimlerChrysler AG, Stuttgart (DE)

( * ) Notice: Subject to any disclaimer, the term of this patent is extended or adjusted under 35 U.S.C. 154(b) by 154 days.

(21) Appl. No.: 09/267,355

(22) Filed: Mar. 15, 1999

(30) Foreign Application Priority Data

Mar. 14, 1998 (DE) ..... 198 11 187

(51) Int. Cl.[7] ..... F02B 37/12
(52) U.S. Cl. ..... 60/602
(58) Field of Search ..... 60/602

(56) References Cited

U.S. PATENT DOCUMENTS 6,020,652 A1 * 2/2002 Daudel et al. ..... 290/45

FOREIGN PATENT DOCUMENTS

DE 195 43 190 A1 5/1997

WO WO 96/39573 12/1996

* cited by examiner

*Primary Examiner*—Noah P. Kamen
(74) *Attorney, Agent, or Firm*—Crowell & Moring LLP

(57) ABSTRACT

An exhaust gas turbocharger with a variable turbine geometry can be adjusted in the fired engine operation by an automatic turbine controller to a definable desired supercharging pressure in the intake port. In the braking operation, the turbocharger can be adjusted by an engine braking system with an automatic braking controller as a function of operating parameters of the internal-combustion engine into a ram position which increases the pressure in the exhaust gas system. A change-over element is provided for the change-over between the engine braking system and the automatic turbine controller. To make the exhaust gas turbocharger variable, the automatic turbine controller and the engine braking system each have a modular design and a separate construction. A manual braking signal to the engine braking system, can be generated in a manually adjustable brake operating device. A change-over element is provided for changing over between the automatic braking controller and the brake operating device.

20 Claims, 1 Drawing Sheet

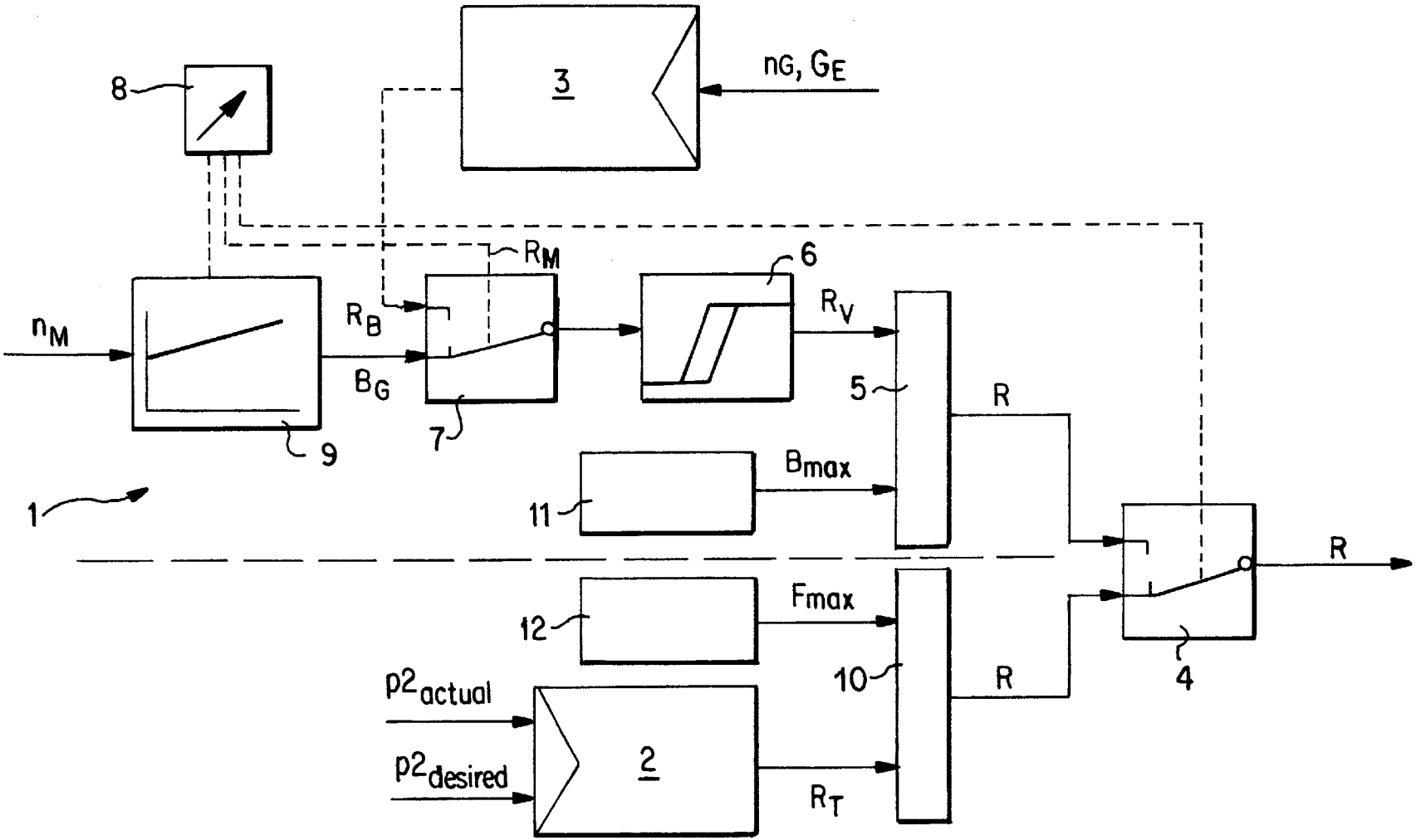
R
4
R
R
5
10
$R_V$
$B_{max}$
$F_{max}$
$R_T$
6
3
2
11
12
$n_G, G_E$
$R_M$
7
$R_B$
$B_G$
9
8
$n_M$
1
$p2_{actual}$
$p2_{desired}$

EXHAUST GAS TURBOCHARGER WITH A VARIABLE TURBINE GEOMETRY

BACKGROUND OF THE INVENTION

This application claims the priority of Germany patent document 198 11 187.8, filed Mar. 14, 1998, the disclosure of which is expressly incorporated by reference herein.

The present invention relates to an exhaust gas turbocharger with a variable turbine geometry, and more particularly, to a turbocharger which, in the engine firing operation, can be adjusted by way of an automatic turbine controller to a definable desired supercharging pressure in the intake port and, in the braking operation, can be adjusted by way of an engine braking system with an automatic braking controller as a function of operating parameters of the internal-combustion engine into a ram position which increases the pressure in the exhaust gas system, a change-over element being provided for the change-over between the engine braking system and the automatic turbine controller.

DE 195 43 190 A1 describes an engine braking system for a supercharged internal-combustion engine whose exhaust gas turbocharger has a variable turbine geometry with adjustable guide baffles. The guide baffles have guide blades which, by way of an adjusting member, can be adjusted such that the flow cross-section of the flow duct in the exhaust gas turbocharger is changed. As a result, depending on the operating condition of the internal-combustion engine, pressures of different degrees can be implemented in the section between the cylinders and the exhaust gas turbocharger. Thereby, the power of the turbine and, therefore, the compression performance of the compressor can be adjusted as required. The adjusting member acting upon the guide blades is controlled by an engine control and characteristic diagrams stored therein.

In order to achieve a braking effect in the braking operation of the internal-combustion engine, the guide baffles are changed into a ram position, in which the flow cross-section of the flow duct is clearly reduced. In the section between the cylinders and the exhaust gas turbocharger, a high excess pressure is built up. Simultaneously, the exhaust gas flows at a high speed through the ducts between the guide blades and acts upon the turbine wheel, whereupon the compressor builds up an excess pressure in the intake system.

The cylinder is therefore acted upon on the input side by an increased supercharging pressure. In addition, despite the opened-up decompression valves, the pressure waves generated by the opening of the exhaust valve cause a residual charge effect. That is, the pressure waves, for a short time, change the exhaust valves of an adjacent cylinder, which is just running at the end of an intake stroke, into an opening position and increase the initial compression pressure in the adjacent cylinder by the flowing-in exhaust gas to a clearly higher level than would be possible by means of the compressor alone. In the braking operation, the piston must therefore carry out more compression work in the compression stroke, whereby a strong braking effect is achieved.

DE 195 43 190 A1 defines a desired engine braking function in the braking operation. The guide blades or blocking bodies, which can be moved into the spaces between the guide blades, are adjusted until the ram pressure required for the desired braking effect is reached in the exhaust gas system between the cylinders and the exhaust gas turbocharger.

WO 96/39573 A1 describes an exhaust gas turbocharger with a variable turbine geometry, in which the adjusting member acting upon the adjustable guide blades of the charger is influenced by an automatic control unit. The automatic control unit comprises an automatic turbine controller and an engine braking system with an automatic braking controller. A change-over element causes a change-over to take place between the automatic turbine controller and the engine braking system. This automatic control unit contains, however, a large number of different automatic control components, and has a complicated and inflexible construction.

SUMMARY OF THE INVENTION

An object of the present invention is to provide a variable exhaust gas turbocharger. In particular, the turbocharger of the present invention is to be equipped at low expenditures with a braking function which can be flexibly adapted to the respective requirement.

According to the present invention, this problem has been solved by providing that the automatic turbine controller and the engine braking system each have a modular design and a separate construction, and as an alternative to the automatic braking controller, a manual braking signal can be supplied to the engine braking system, which signal can be generated in a manually adjustable brake operating device. A change-over element is provided for the change-over between the automatic braking controller and the brake operating device, and the signal generated by the manual brake operating device can be compared in a comparison element with a rotational-speed-dependent braking limit value.

The division into two separate modular systems with one automatic controller respectively, one for the engine firing operation and one for the braking operation, has the substantial advantage that exhaust gas turbochargers which are already used in an internal-combustion engine and are not yet equipped for the braking operation can be used at minimal expenditures also for the braking operation. An additional engine braking system with an automatic braking controller must only be provided in which the characteristic diagrams and parameters relevant to the braking operation are stored. An already installed automatic turbine controller, by way of which the engine firing operation is automatically controlled, must be changed just as little as the other structural elements required for the automatic control, such as sensors or adjusting elements which normally exist anyhow for the automatic control of the firing operation and can now also be used for the automatic braking control.

It is another advantage of the present invention that with a simple exchange of the automatic braking controller or of the engine braking system, various automatic control algorithms and characteristic diagrams or parameters influencing the automatic control can be implemented irrespective of the engine control employed. For example, automatic braking controllers which are adapted to various turbine geometries, whereby the variability is increased, can be provided and used.

Furthermore, a manually generated braking signal can be supplied to the engine braking system by way of a change-over element. The braking signal can be generated in a manually adjustable brake operating device, such as a steering column hand brake lever. As required, as an alternative to the automatic braking controller, a manually adjustable braking torque can be generated. A comparison element with a rotational-speed-dependent braking limit value is preferably also connected to the engine braking system in order to ensure that with a manual demand, the permitted braking power maximum is not exceeded at the current rotational engine speed so that the turbine geometry will not be critically stressed.

In order to be able to change between the braking operation and the engine firing operation, a change-over element is provided. Thereby, on one hand, the automatic turbine controller can be assigned to the engine operation and, on the other hand, the automatic braking controller can be assigned to the braking operation. The engine braking system can thus be coupled to an already existing automatic turbine controller. This feature results in the additional advantage that with only one coupling, both braking possibilities, i.e., the braking by way of the automatic braking controller as well as the manual demand of the braking performance, can be connected.

The braking function which can be set in the automatic braking controller is advantageously a constant braking torque so that the vehicle is decelerated in a constant manner, or a constant speed, that is, a cruise control. In the latter case, for determining the current speed, the transmission output rotational speed and the engaged gear are expediently determined. These quantities can be measured or computed by the existing automatic vehicle engine control system, and the automatic vehicle engine control system can also carry out the desired-actual comparison of the speed.

A comparison element for comparing the control signal generated by the automatic braking controller with a definable maximal braking signal is preferably connected behind the automatic braking controller. The comparison element takes over the function of an electronic stop in order to ensure that no mechanical overloading takes place as the result of an excessive pressure buildup.

Furthermore, a delay element can be arranged behind the automatic braking controller. The delay element has the function of transmitting control signals of the automatic braking controller with a delay in order to prevent pressure peaks in the cylinder which may occur if a high excess pressure is built up while a throttle valve arranged on the cylinder is still closed. During the switching-on of the turbine geometry adjustment and the switching-off of the throttle valve, the delay element provides a delayed transmission of the control signal. Thereby, the throttle valve will not still be closed when pressure is already being built up in the exhaust gas system.

BRIEF DESCRIPTION OF THE DRAWINGS

Other objects, advantages and novel features of the present invention will become apparent from the following detailed description of the invention when considered in conjunction with the accompanying drawings.

The sole FIGURE is a schematic view of an engine braking system for automatically controlling and adjusting a desired braking performance of an internal-combustion engine, particularly an internal-combustion engine of a utility vehicle, having an exhaust gas turbocharger with a variable turbine geometry.

DETAILED DESCRIPTION OF THE DRAWING

The braking system 1 shown in the sole FIGURE comprises an automatic braking controller 3, diverse control circuit elements 4, 5, 6, 7, 8, 9 and 11 as well as additional adjusting elements and sensors (not shown). The engine braking system 1 communicates with an automatic turbine controller 2 and automatic control circuit elements 10, 12 associated with the automatic turbine controller 2.

The engine braking system 1 and the automatic turbine controller 2 both control the adjustable geometry of the turbine of the exhaust gas turbocharger. The engine braking system 1 is active in the braking operation, and the automatic turbine controller 2 is active in the engine firing operation. The change-over between the engine braking system 1 and the automatic turbine controller 2 takes place via a change-over element 4.

In the braking operation of the vehicle, a control signal $R_B$ is generated in the automatic braking controller 3, with the value of the control signal depending on the used control algorithm and the selected engine braking function. A constant braking torque, a constant speed or another function can be defined. If a constant speed (cruise control function) is selected, for example, the control signal $R_B$ is computed from the comparison of the defined desired speed $v_{des}$ with the actual speed $v_{actual}$. Thereby, the actual speed $v_{actual}$ can be determined from the measurement of the transmission output rotational speed $n_G$ and by the gear recognition $G_E$. The desired-actual comparison of the cruise control function can also take place within an automatic vehicle engine control in order to optimally utilize already existing automatic control components.

Instead of a braking signal generated in the automatic braking controller 3, a braking signal $R_M$ generated by a manual intervention can be fed to the engine braking system 1. The braking signal is generated on demand by the driver in a brake operating device 8 to be manually operated. The manually generated braking signal $R_M$ is supplied to the engine braking system 1 by a change-over element 7 for providing the change-over between the automatic braking controller 3 and the manual brake operating device 8.

If the braking takes place manually, the manual braking signal $R_M$ is expediently and advantageously compared in a comparison element with a rotational-speed-dependent braking limit value $B_G$ and is possibly reduced to this braking limit value $B_G$ in order to avoid an overloading of the turbine geometry and limit the adjusting position of the turbine diffuser because a closing which exceeds this limit position may again reduce the braking torque. The braking limit value $B_G$ is generated as a function of the rotational engine speed $n_M$ in a generator 9 in which a characteristic braking value-rotational engine speed diagram is stored.

The braking signal, either the manually generated signal $R_M$ or the signal $R_B$ generated by the automatic braking controller, is supplied to a delay element 6 which provides a delayed transmission of the braking signal during the switching-on and switching-off. For the delay, various functions can be implemented, such as a hysteresis function. Thus, during the switching-on, turbine geometry is changed into the ram position with a delay and, during the switching-off, the throttle valve on the cylinder is changed to its closing position with a delay. The delay element 6 generates a signal $R_v$ as the output signal.

The signal $R_v$ is supplied to a comparison element 5 and is limited to a maximal braking value $B_{max}$ which is filed or generated in a parameter generator 11. As the output signal, a control signal R is generated in the comparison element 5. The control signal R is supplied as an electric signal for changing the adjusting width of the variable turbine geometry (pulse width modulation) to an electropneumatic transducer (not shown). The signal is changed to an adjusting signal for acting upon an adjusting element which adjusts the turbine geometry.

The change-over between the braking operation with an activated automatic braking controller 3 or a manual braking torque demand by way of the brake operating device 8 and the automatic turbine controller 2 for the fired operation takes place via the change-over element 4. As the input quantity, for example, the desired charging pressure $p2_{des}$ and the actual charging pressure $p2_{actual}$ in the intake system are supplied to the automatic turbine controller 2 and produces, as the output value, a control signal $R_T$ which is limited in a comparison element 10 to a maximal value $F_{max}$ which is generated or stored in a generator 12.

Various automatic control strategies can be implemented with the illustrated engine braking system. The supercharging pressure, the exhaust gas counterpressure or the differential pressure between the supercharging pressure and the exhaust gas counterpressure can, for example, be used as the command variable for the automatic braking control.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An exhaust gas turbocharger with a variable turbine geometry which, in an engine firing operation, is adjustable via an automatic turbine controller to a definable desired supercharging pressure in an intake port thereof and, in a braking operation, is adjustable via an engine braking system with an automatic braking controller as a function of operating parameters of the internal-combustion engine into a ram position which increases pressure in an exhaust gas system, comprising a first change-over element for a change-over between the engine braking system and the automatic turbine controller, wherein the automatic turbine controller and the engine braking system are individual modules, and a second change-over element operative to provide a change-over between the automatic braking controller and a manually adjustable brake operating device other than a vehicle service brake, whereby the manually adjustable brake operating device is configured to generate a manual braking signal that is directly suppliable to the engine braking system and that is compared with a rotational-speed-dependent braking limit value.

2. The exhaust gas turbocharger according to claim 1, wherein a constant braking torque is adjustable in the automatic braking controller.

3. The exhaust gas turbocharger according to claim 1, wherein a constant desired speed is adjustable in the automatic braking controller.

4. The exhaust gas turbocharger according to claim 3, wherein a constant braking torque is adjustable in the automatic braking controller.

5. The exhaust gas turbocharger according to claim 3, wherein means is provided for determining actual speed from transmission output rotational speed and gear recognition.

6. The exhaust gas turbocharger according to claims 1, wherein a comparison element is configured to compare a control signal generated by the automatic braking controller with a definable maximal braking value and is operatively connected downstream of the automatic braking controller.

7. The exhaust gas turbocharger according to claim 6, wherein a constant braking torque is adjustable in the automatic braking controller.

8. The exhaust gas turbocharger according to claim 7, wherein a constant desired speed is adjustable in the automatic braking controller.

9. The exhaust gas turbocharger according to claim 8, wherein means is provided for determining actual speed from transmission output rotational speed and gear recognition.

10. The exhaust gas turbocharger according to claim 1, wherein a delay element for the delayed transmission of the control signal is connected downstream of the automatic braking controller.

11. The exhaust gas turbocharger according to claim 10, wherein means is provided for delaying control signal for switching on the geometry adjustment of the turbine.

12. The exhaust gas turbocharger according to claim 10, wherein means is provided for delaying the control signal for switching off a throttle valve arranged on a cylinder.

13. The exhaust gas turbocharger according to claim 12, wherein means is provided for delaying control signal for switching on the geometry adjustment of the turbine.

14. The exhaust gas turbocharger according to claim 1, wherein means is provided for utilizing supercharging pressure as a command variable for the automatic braking control.

15. The exhaust gas turbocharger according to claim 1, wherein means is provided for utilizing exhaust gas counterpressure as a command variable for the automatic braking control.

16. The exhaust gas turbocharger according to claim 1, wherein means is provided for utilizing a pressure gradient between supercharging pressure and exhaust gas counterpressure as a command variable for the automatic braking control.

17. The exhaust gas turbocharger according to claim 1, wherein a comparison element for comparing control signal ($R_T$) generated by the automatic turbine controller with a definable maximal value for the automatic turbine controller is connected downstream of the automatic turbine controller.

18. A turbocharging process using an exhaust gas turbocharger with a variable geometry which, in an engine firing operation, is adjustable via an automatic turbine controller to a definable desired supercharging pressure in an intake port thereof and, in a braking operation, is adjustable via an engine braking system with an automatic braking controller as a function of operating parameters of the internal-combustion engine into a ram position which increases pressure in an exhaust gas system, comprising a change-over element for a change-over between the engine braking system and the automatic turbine controller, comprising the steps of directly supplying, in lieu of the automatic braking controller, a manual braking signal to the engine braking system, providing a selective change-over between the automatic braking controller and a brake operating device other than a vehicle service brake which directly supplies the manual braking signal, and comparing the manual braking signal with a rotational speed dependent braking limit value.

19. The process according to claim 18, wherein a constant braking torque is adjustable.

20. The process according to claim 18, wherein a constant desired speed is adjustable.

* * * * *